US007475558B2

(12) United States Patent
Perry

(10) Patent No.: US 7,475,558 B2
(45) Date of Patent: Jan. 13, 2009

(54) CONTROL OF A HEATING AND COOLING SYSTEM FOR A MULTI-LEVEL SPACE

(75) Inventor: David L. Perry, St. Louis, MO (US)

(73) Assignee: Emerson Electric Co., St. Louis, MO (US)

( * ) Notice: Subject to any disclaimer, the term of this patent is extended or adjusted under 35 U.S.C. 154(b) by 629 days.

(21) Appl. No.: 11/207,300

(22) Filed: Aug. 19, 2005

(65) Prior Publication Data

US 2007/0039338 A1 Feb. 22, 2007

(51) Int. Cl.
*F25D 17/00* (2006.01)
*F24F 7/00* (2006.01)

(52) U.S. Cl. ..... 62/180; 62/186; 236/49.3; 454/231

(58) Field of Classification Search ..... 62/178, 62/180, 186; 236/49.3, 51, 94; 454/231, 454/236

See application file for complete search history.

(56) References Cited

U.S. PATENT DOCUMENTS 2,118,949 A * 5/1938 Scott ..... 62/91
2,300,848 A * 11/1942 Fenner ..... 454/236
4,168,797 A * 9/1979 Luke ..... 236/11
4,182,401 A * 1/1980 Pinnell et al. ..... 165/210
4,245,779 A * 1/1981 Ardiente ..... 236/1 G
4,915,294 A 4/1990 Wylie ..... 236/49.3
4,993,629 A 2/1991 Wylie ..... 236/11
5,390,206 A * 2/1995 Rein et al. ..... 375/130
5,413,165 A 5/1995 Wylie ..... 165/22
5,803,357 A * 9/1998 Lakin ..... 236/78 B
5,833,134 A * 11/1998 Ho et al. ..... 236/49.3
5,927,599 A * 7/1999 Kath ..... 236/47
6,449,533 B1 * 9/2002 Mueller et al. ..... 700/276

* cited by examiner

*Primary Examiner*—Marc E Norman
(74) *Attorney, Agent, or Firm*—Harness, Dickey & Pierce, P.L.C.

(57) ABSTRACT

A heating and cooling system for a multi-level space is provided that comprises at least one lower level return air duct and at least one upper level return air duct, and a thermostat for controlling the operation of the heating or cooling system through either a low voltage cooling activation signal or a low voltage heating activation signal. The heating and cooling system further comprises a first motorized damper having connection means for receiving at least a low voltage heating activation signal from the thermostat, the first motorized damper being installed in each lower level return duct and configured to drive the damper to an open position when the connection means receives a low voltage heating activation signal, wherein the first motorized damper is operatively closed when the thermostat alternatively transmits a low voltage cooling activation signal such that the cooling system substantially receives no air flow through each lower level return air duct and effectively receives only air flow from the upper level of the space.

3 Claims, 3 Drawing Sheets

CONTROL OF A HEATING AND COOLING SYSTEM FOR A MULTI-LEVEL SPACE

FIELD OF THE INVENTION

This invention generally relates to a system for controlling a heating and cooling system for a multi-level building, and more specifically to control of air circulation in a multi-level space.

BACKGROUND OF THE INVENTION

In heating multi-level structures, the flow of warm air rising up stairways reduces the heating requirement of the upper floors, while cool air falling increases the demand for heating on the lower level. Likewise, in cooling multi-level structures, the flow of warm air rising up stairways increases the cooling requirement of the upper levels while decreasing the demand for cooling on the lower level. The end result is that the greater portion of warm air in the space resides in the upper levels, while the greater portion of cool air resides in the lower level. This stratification of temperature across multiple levels can be problematic for conventional heating and cooling systems, which substantially distribute conditioned air evenly through out multiple levels. For this reason, separate heating and cooling systems are often installed and employed to supply conditioned air to each level as needed. Where an upper level is often warmer than the lower level, a lower level heating system would typically operate more during the winter than an upper level heating system, and an upper level cooling system would operate more during the summer than a lower level cooling system. However, installing and operating a heating and cooling system for each level is more costly than installing only one heating and cooling system with sufficient capacity. Previous attempts have also been made to employ individual zone dampers at various vent outlets to supply conditioned air to only those zones that require air conditioning (eg.—upper level zones). However, zoning systems can also involve considerable costs associated with installing zone dampers and zone temperature sensors in each room of an existing home, where a conventional heating and cooling system may comprise as many as eight or more vent outlets in a multi-level space.

SUMMARY OF THE INVENTION

The present invention relates to a control system for controlling return air flow in a heating and cooling system for a multi-level space. In one embodiment, a heating and cooling system for a multi-level space is provided that comprises at least one lower level return air duct and at least one upper level return air duct, and a thermostat for controlling the operation of the heating or cooling system, using low voltage activation signals. The heating and cooling system further comprises a first motorized damper having connection means for receiving at least a low voltage heating activation signal from the thermostat, the first motorized damper being installed in each lower level return duct and configured to drive the damper to an open position when the connection means receives a low voltage heating activation signal, wherein the first motorized damper is operatively closed when the thermostat alternatively transmits a low voltage cooling activation signal such that the cooling system substantially receives no air flow through each lower level return air duct and effectively receives only air flow from the upper level of the space.

In accordance with one aspect of the present invention, some embodiments of a heating and cooling system for a multi-level space are provided that comprise controllable motorized dampers in each lower level return air duct which are operably closed when the thermostat activates the cooling system, such that the cooling system substantially receives no air flow through each lower level return air duct and effectively receives only air flow from the upper level of the space. In these embodiments, the cooling system removes the greater portion of warm air in the space that resides on the upper levels, and conditions the warm air for even distribution through out all levels of the space.

In accordance with another aspect of the present invention, some embodiments of a heating and cooling system for a multi-level space are provided that further comprise controllable motorized dampers in each upper level return air duct which are operably closed when the thermostat activates the heating system, such that the heating system substantially receives no air flow through each upper level return air duct and effectively receives only air flow from the lower level of the space. In these embodiments, the heating system removes the greater portion of cold air in the space that resides on the lower levels, and conditions the warm air for even distribution through out all levels of the space.

In yet another aspect of the present invention, one embodiment of a controllable damper for a lower level return air duct is provided that comprises a connection means for receiving at least a low voltage heating activation signal transmitted by the thermostat, at least one pivotal damper operable to move between an open and a closed position, and a motor configured to drive the pivotal damper to an open position when the connection means receives a low voltage heating activation signal, wherein the pivotal damper is operatively closed when the thermostat alternatively transmits a low voltage cooling activation signal such that the cooling system substantially receives no air flow through the lower level return air duct and effectively receives only air flow from the upper level of the space. The controllable damper for upper level return air ducts includes a connection means for receiving at least a low voltage cooling activation signal transmitted by the thermostat, at least one pivotal damper operable to move between an open and a closed position, and a motor configured to drive the pivotal damper to an open position when the connection means receives a low voltage cooling activation signal, wherein the pivotal damper is operatively closed when the thermostat alternatively transmits a low voltage heating activation signal. When the damper is in the closed position, the damper restricts air flow through the upper level return air duct, such that the heating system receives substantially all return air flow from the lower level of the space and substantially no return air flow from the upper level return air duct.

Further aspects of the present invention will become apparent from the detailed description provided hereinafter. It should be understood that the detailed description and specific examples, while indicating various embodiments and methods of the invention, are for illustration purposes only and are not intended to limit the scope of the invention.

BRIEF DESCRIPTION OF THE DRAWINGS

Corresponding reference numerals indicate corresponding parts throughout the several views of the drawings.

DETAILED DESCRIPTION OF THE INVENTION

Figure 1:
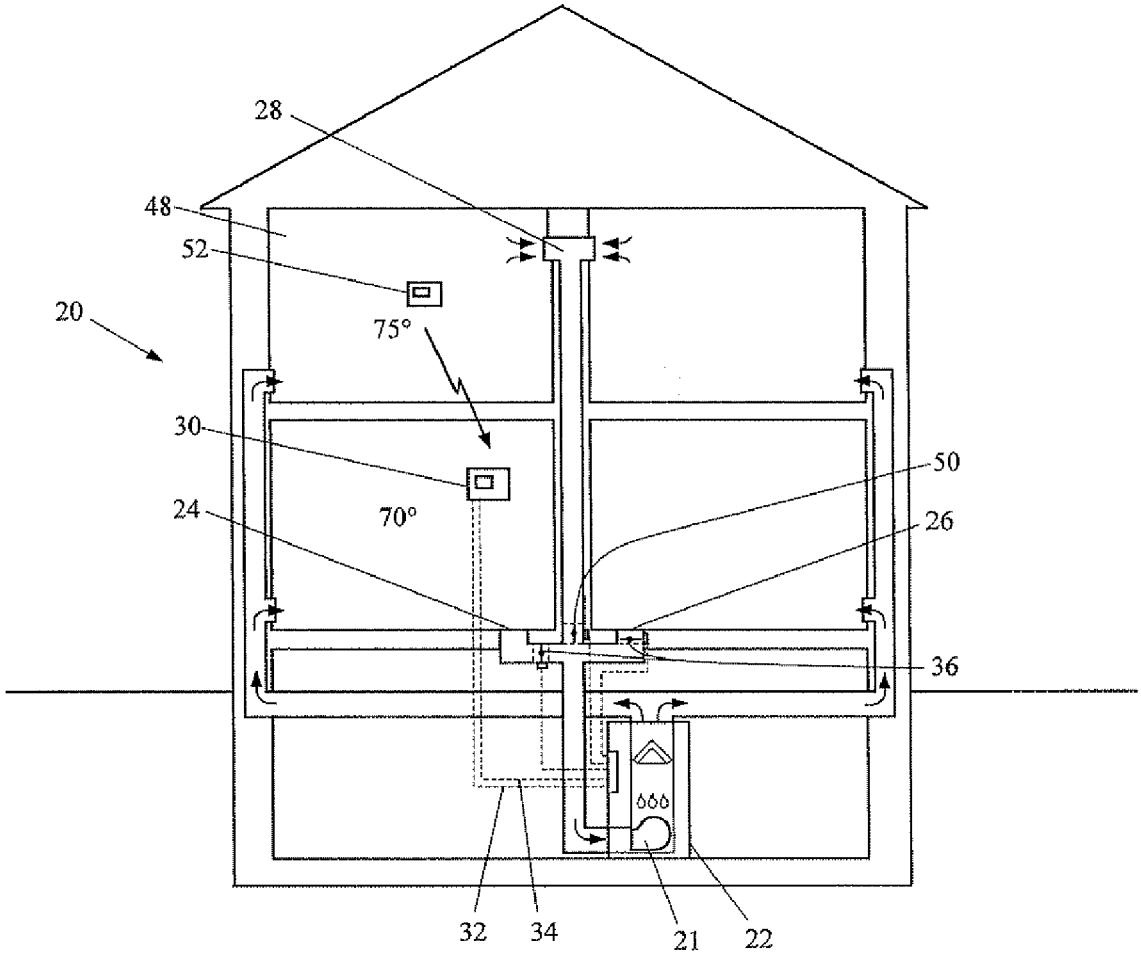
FIG. 1 is an illustration of one embodiment of a heating and cooling system for a multi-level space in accordance with the principles of the present invention.

One embodiment of a control system for a heating and cooling unit in a multi-level space is shown generally at 20 in FIG. 1. The heating and cooling unit 22 generally has at least one lower level return air duct 24 leading to the heating and cooling unit, and preferably comprises at least two lower level return air ducts 24 and 26 as shown in FIG. 1. The number of lower level return air ducts 24 may be any number of return air ducts and depends on the size of the floor level, although the number is typically much less than the number of vent outlets. The control system includes a thermostat 30 for controlling the operation of the heating or cooling unit 22 through either a low voltage cooling activation signal or a low voltage heating activation signal. The thermostat 30 senses the temperature in the space local the thermostat and controls the activation of the heating or cooling unit 22 when the sensed local temperature differs by more than a predetermined amount from a set point temperature. Upon sensing a temperature more than a predetermined amount below the set point temperature, the thermostat 30 transmits a low voltage signal to the heating system via conventional wiring means 32. Specifically, the thermostat 30 switches a low voltage source, such as a 24 volt alternating current source, to provide a low voltage head demand signal via conventional wiring 32 to signal the heating unit 22 to initiate heating. Likewise, upon sensing a temperature more than a predetermined amount above the set point temperature, the thermostat 30 transmits a low voltage signal to the cooling system via wire 34. Specifically, the thermostat 30 switches a low voltage source, such as a 24 volt alternating current source, to connect a low voltage source to wire 34 to signal the cooling unit 22 to activate an indoor circulating fan contactor, and to another wire (not shown) to activate a compressor contactor. It should be noted that while the thermostat 30 transmits signals via conventional wiring, the thermostat 30 may alternately utilize wireless transmission of signals as well for activating the heating or cooling system.

Figure 2:
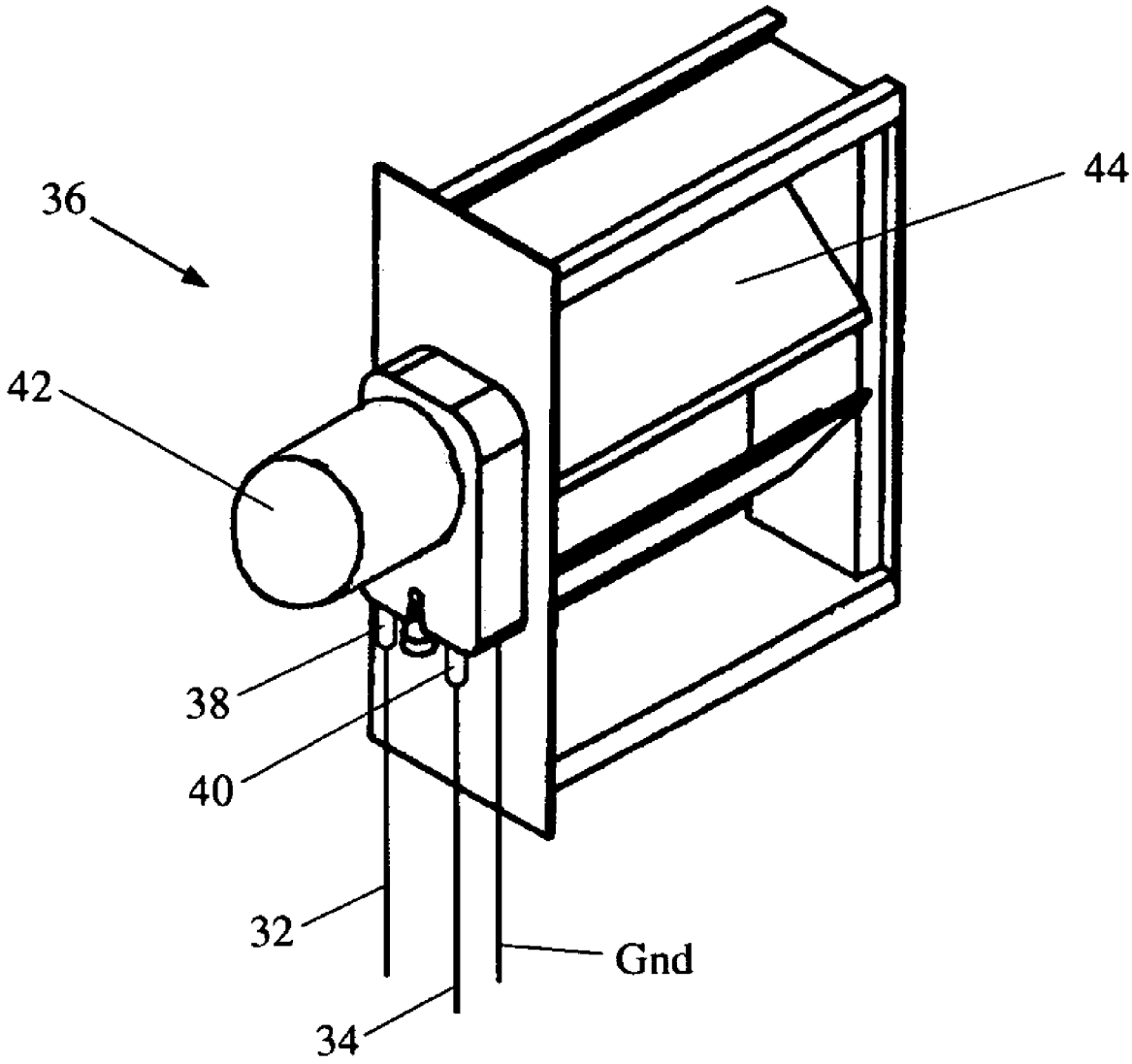
FIG. 2 is a perspective view of one embodiment of a controllable damper for a lower level return air duct in a multi-level space.
Figure 3:
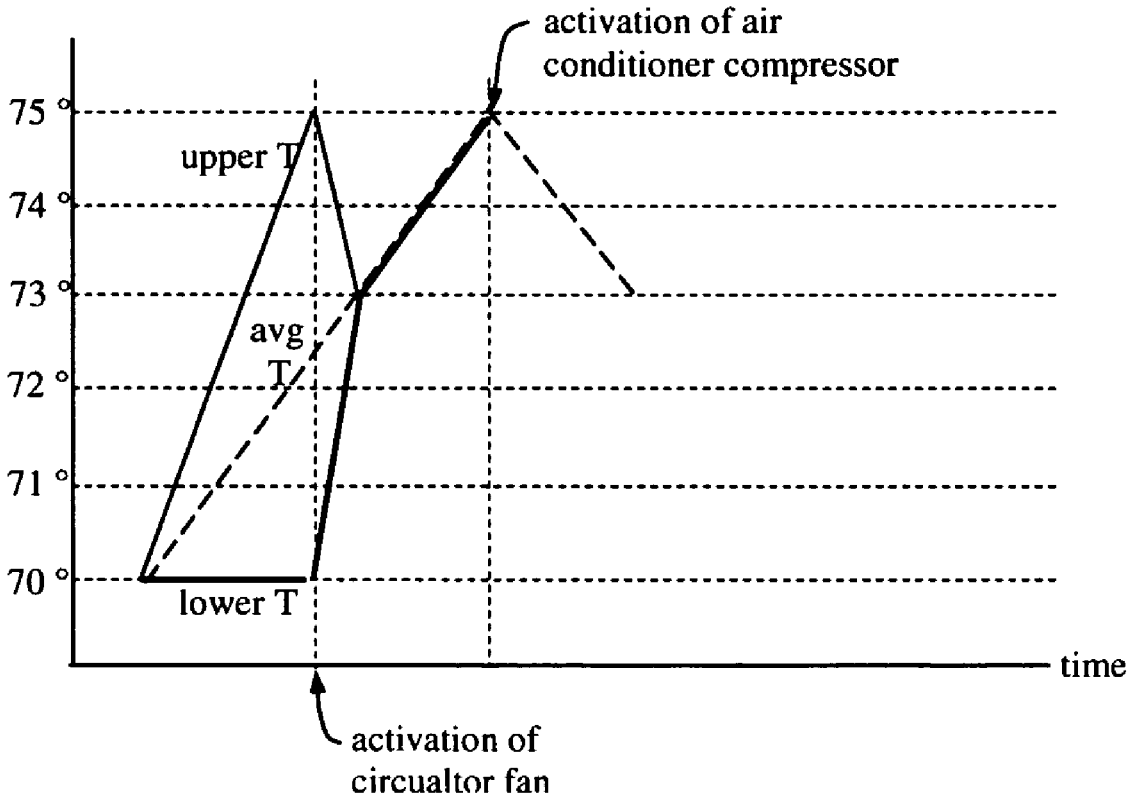
FIG. 3 is a temperature graph illustrating an example of operation of one embodiment of a control system of the present invention.

Referring to FIG. 2, the control system 20 further comprise a first motorized damper 36 having connection means 38 for receiving at least a low voltage heating demand activation signal from the thermostat 30, the first motorized damper 36 being installed in each lower level return duct 24 and 26 and configured to drive the damper 44 to an open position when the connection means 38 receives a low voltage heating activation signal. The connection means 38 for the motorized damper 36 is preferably connected to ground of the low voltage source and to the termination of wire 32 at the heating unit 22, in parallel with the heating load. Thus, when the thermostat 30 switches a low voltage "heating" signal via wire 32, an activation signal is provided to the heating unit 22. The heating unit 22 activates the heating load and drives the first motorized damper 36 to an open position. In this position, the heating system draws or receives return air for the heating system through the at least one open lower level return air damper, which are positioned much closer to the heating system than the upper level return air ducting 28. As a result of the static pressure in the upper level return air ducting 28, the heating unit 22 receives a substantial portion of its return air from the lower level where the greater portion of cool air from the space resides. The heating unit 22 then heats the cool air from the return duct, which is then evenly distributed through out all levels of the space. By drawing the coolest air from the space, the system substantially reduces stratification across multiple levels of the space being heated.

In one embodiment of a lower level return air damper, the first motorized damper comprises a motor 42 for driving the damper 44 to an open position, and a return spring (not shown) to operatively return the damper 44 to an open position in the absence of a low voltage heating activation signal. The first motorized damper 36 is operatively closed when the thermostat 30 alternatively transmits a low voltage cooling activation signal, such that the cooling unit 22 substantially receives no air flow through each lower level return air duct 24 and 26 and effectively receives only air flow from the upper level 48 of the space. Thus, this embodiment of a control system comprises a thermostat 30 that provides for activating a cooling unit 22 and at least one controllable motorized damper 36 in at least one lower level return air duct. The controllable damper 36 is operably closed when the thermostat 30 activates cooling such that the cooling unit 22 substantially receives no air flow through each lower level return air duct 24 and 26 and effectively receives only air flow from the upper level 48 of the space. Utilizing this embodiment, the cooling unit 22 removes the greater portion of warm air from the space that resides on the upper level 48, and conditions the warm air for even distribution through out all levels of the space, to significantly reduce stratification across multiple levels.

A second embodiment of a lower level motorized damper 36 may also be employed, which alternately comprises connection means 40 for receiving a low voltage cooling activation signal transmitted by the thermostat 30 via wire 34, where the motor is configured to drive the pivotal damper 44 to a closed position when the connection means 40 receives a low voltage cooling activation signal from the thermostat 30. In this second embodiment, the motorized damper may alternately be driven to an open position and a closed position by the motor without employing a return spring.

In some embodiments of a control system for a heating and cooling unit 22 in a multi-level space, the control system may further comprise at least one upper level return air duct 28, and at least one upper level controllable motorized damper 50 in the at least one upper level return air duct 28. In some applications, the at least one upper level return air duct 28 may comprise two or more controllable motorized dampers 50 in the upper level return air duct. The control system further comprises a thermostat 30 in connection with the heating and cooling unit 22 for controlling the operation of the heating or cooling unit 22 through either a low voltage cooling activation signal or a low voltage heating activation signal. Upon sensing a temperature that is more than a predetermined amount above the set point temperature, the thermostat 30 transmits a low voltage signal to the cooling system via wire 34. When the thermostat 30 sends a low voltage cooling activation signal, the first motorized dampers 36 are operatively closed, such that the cooling unit 22 substantially receives no air flow through each lower level return air duct 24 and 26. The thermostat 30 transmits the cooling activation signal by switching a low voltage source, such as a 24 volt alternating current source, to connect the low voltage source to wire 34. A connection means 38 for the second motorized damper 50 is preferably connected to the termination of wire 34 at the cooling unit 22, and is connected in parallel with a circulating fan contactor of the cooling unit 22. The second motorized damper 50 comprises a motor 42 that is configured to drive a damper 44 to an open position when the connection means 38 receives a low voltage cooling activation signal via wire 34. Thus, the thermostat 30 initiates cooling by switching a voltage source to activate the compressor contactor and by switching a low voltage source to wire 34. The low voltage applied to wire 34 also activates the circulating fan contactor and drives the second motorized damper 50 to an open position. In this position, the cooling system draws or receives return air for the cooling system through the open upper level return air damper 50, since the lower level return air dampers 36 are each in a closed position. As a result, the cooling unit 22 receives a substantial portion of its return air from the upper level where the greater portion of warm air from the space resides. The cooling system then conditions the warm air for even distribution through out all levels of the space, to significantly reduce stratification.

A second embodiment of a control system for a heating and cooling unit in a multi-level system is also provided, which further comprises at least one remote temperature sensor 52 in the upper level 48 for communicating upper level temperature information to a thermostat 30. The thermostat 30 is capable of initiating heating or cooling operation when the at least one remote temperature sensor senses an upper level temperature that differs from the set point temperature by more than a predetermined amount. The thermostat 30 is further capable of transmitting a low voltage activation signal for only the circulating fan of the cooling unit 22, independent of compressor operation. Thus, the thermostat 30 can also initiate operation of only the cooling system's circulating fan. The remote temperature sensor 52 senses the upper level temperature information and periodically transmits the sensed temperature information via wireless communication means to the thermostat 30. The thermostat 30 receives the transmitted temperature information from the remote sensor 52, and is configured to send a low voltage signal via wire 34 for activating the circulating fan when the upper level temperature elevates relative to the lower level temperature. The circulating fan pulls air from substantially the upper level of the space by virtue of the closed damper 36, and evenly distributes the elevated temperature air throughout all levels of the space. The thermostat 30 may be configured to activate the circulating fan when the sensed upper level temperature is more than a predetermined amount above the sensed lower level temperature. Alternatively the thermostat 30 may be configured to activate the circulating fan when the average of the sensed upper level and sensed lower level temperatures is within a predetermined amount of the set point temperature.

The thermostat 30 of the control system sends a low voltage circulating fan activation signal when the first motorized dampers 36 are operatively closed. In this position, the circulating fan substantially receives no air flow through each lower level return air duct 24 and 26. The thermostat 30 sends the low voltage circulating fan activation signal by switching a low voltage source, such as a 24 volt alternating current source, to connect the low voltage source to a wire 34. A connection means 38 for the second motorized damper 50 is preferably connected to the termination of wire 34 at the cooling unit 22, and is connected in parallel with the circulating fan contactor of the cooling system. Thus, when the thermostat 30 switches a low voltage source to wire 34 and the circulating fan contactor, the thermostat 30 activates both the circulating fan contactor and drives the second motorized damper 50 to an open position. In this position, the circulating fan draws or receives return air through the open upper level return air damper 50, since the lower level return air dampers 36 are each in a closed position. As a result, the circulating fan receives a substantial portion of its return air from the upper level where the greater portion of warm air from the space resides, and evenly redistributes the warm air through out all levels of the space to prevent stratification from occurring.

In operation, the control system may be employed to prevent the stratification exemplified in FIG. 1 from occurring as described below. In this example, the thermostat 30 preferably has a set point temperature of 75 degrees Fahrenheit. The thermostat 30 is configured to send a low voltage fan signal for activating the circulating fan when the difference between the sensed upper level temperature and the lower level temperature is equal to or more than a predetermined amount, such as 5 degrees. When seasonal temperatures are moderate, such as a low of 67 degrees and a high of about 80 degrees, the rate at which heat outside the house is conducted into the lower level may be comparable to the rate at which heat rises from the lower level to the upper level. In this situation, the temperature of the lower level remains somewhat constant, such that the air conditioner will operate infrequently and the temperature of the multi-level space will stratify. Referring to the stratification example in FIG. 1, the remote temperature sensor 60 would sense a temperature in the upper level of 75 degrees Fahrenheit, and the thermostat 30 would sense a temperature in the lower level of 70 degrees Fahrenheit. The upper level temperature could continue to elevate above 80 degrees before the lower level temperature increased to the 75 degree set point temperature. In the example in FIG. 1, the thermostat 30 would respond to the temperature differential of five degrees by activating the circulating fan of the cooling system. The circulating fan would draw or receive substantially all return air from the upper level of the space, and would evenly distribute the air throughout all levels of the space. The greater portion of warm air in the upper level would then be drawn from the upper level by the circulating fan, and redistributed throughout the rest of the space, to average the 70 degree lower level temperature and the 75 degree upper level temperature. This operation of the circulator fan would continue until the temperature difference between levels drops below about two degrees, so that the upper level does not become uncomfortable. Thus, the control system 20 provides for reducing temperature stratification between upper and lower levels without relying on air conditioner operation (operating the compressor). A conventional thermostat would operating the air conditioning system (including the compressor) when the sensed upper level temperature reaches the 75 degree set point, which would reduce the lower level temperature below 70 degrees and cause the lower level to become uncomfortably cold. Operating the air conditioning unit (including the compressor) when the lower level reached the set point temperature would allow the upper level temperature to possibly rise over 80 degrees. Thus, conventional systems do not offer the advantage of the present control system.

In another embodiment, the thermostat 30 is configured to activate the circulating fan when the average of the sensed upper level and sensed lower level temperatures is within a predetermined amount of the set point temperature. In the example shown in FIG. 1, the thermostat 30 preferably has a set point temperature of 75 degrees Fahrenheit. such as a low of 67 degrees and a high of about 80 degrees, the rate at which heat outside the house is conducted into the lower level may be comparable to the rate at which heat rises from the lower level to the upper level. In this situation, the temperature of the lower level remains somewhat constant, such that the air conditioner will operate infrequently and the temperature of the multi-level space will stratify. In the stratification example shown in FIG. 1, the thermostat 30 would sense a temperature in the lower level of 70 degrees Fahrenheit. Warm air rising within the space will gradually increase the upper level temperature, such that the remote temperature sensor 60 in the upper level may sense a temperature of 75 degrees Fahrenheit. Waiting to operate the air conditioning unit (including the compressor) until the lower level temperature reaches the 75 degree set point temperature would allow the upper level temperature to possibly rise over 80 degrees. Operating the air conditioning system (including the compressor) when the sensed upper level temperature reaches the 75 degree set point would reduce the 70 degree lower level temperature cause the lower level to become uncomfortably cold. In such a situation, the average of both sensed temperatures would be 72½ degrees. This average temperature of the upper level and lower level would be within a predetermined amount (3 degrees in this exemplary embodiment) of the 75 degree set point temperature. The thermostat 30 would accordingly activate the circulating fan. The circulating fan would draw or receive substantially all return air from the upper level of the space, and would evenly distribute the air throughout all levels of the space. The greater portion of warm air in the upper level would then be drawn from the upper level by the circulating fan, and redistributed throughout the rest of the space, to average the 70 degree lower level temperature and the 75 degree upper level temperature. The circulator fan would continue to operate until the heat being conducted into the space causes the average sensed temperature to increase to the 75 degree set point temperature, at which point the air conditioner would be activated. The circulator fan may also continue to operate until the average temperature in the space drops below a predetermined amount (3 degrees in this exemplary embodiment) of the set point temperature, which may occur when the outdoor temperature drops during the evening/night. Thus, the control system 20 provides for reducing temperature stratification between upper and lower levels to improve comfort, and extends the time between operating periods that the air conditioning unit (including the compressor) is requested to cool the space.

The advantages of the above described embodiment and improvements should be readily apparent to one skilled in the art, as to enabling control of a heating and cooling unit in a multi-level space. Additional design considerations may be incorporated without departing from the spirit and scope of the invention. Accordingly, it is not intended that the invention be limited by the particular embodiment or form described above, but by the appended claims.

What is claimed is:

1. A cooling system for a multi-level space having at least one lower level return air duct and at least one upper level return air duct, the system comprising:

a thermostat having a sensor for sensing the temperature in the lower level, the thermostat being capable of controlling the operation of the cooling system by switching a low voltage activation signal transmitted by the thermostat via a wire connected to the cooling system;

a remote sensor in the upper level for communicating upper level temperature information to the thermostat; and a motorized damper installed in each of the at least one lower level return air ducts, each motorized damper having connection means for connecting the motorized damper in parallel with the wire transmitting the low voltage activation signal to the cooling system, such that each motorized damper is actuated and moves to an open position when the thermostat switches a low voltage activation signal to the cooling system, wherein each motorized damper is deactuated when the thermostat switches a low voltage activation signal to the circulating fan only, and is operatively closed by a return spring;

wherein the thermostat sends a low voltage signal to the circulator fan for activating the circulator fan when the sensed upper level temperature is more than a predetermined amount above the sensed lower level temperature, such that with the dampers in the lower level return air duct being closed by a return spring, the circulating fan substantially draws no return air flow through each lower level return air duct and effectively draws return air flow only from the at least one return air duct in the upper level of the space, to redistribute warm air from the upper level and reduce the temperature stratification in the space.

2. A heating and cooling system for a multi-level space having at least one lower level return air duct and at least one upper level return air duct, comprising:

a thermostat having a sensor for sensing the temperature in the lower level, the thermostat being capable of operating in a heating mode or cooling mode to control the operation of the heating or cooling system by switching a low voltage activation signal to either the heating system or the cooling system;

a remote sensor in the upper level for communicating upper level temperature information to the thermostat;

a motorized damper installed in each of the at least one upper level return air ducts, each motorized damper in an upper level return air duct having connection means for connecting the motorized damper in parallel with the low voltage activation signal to the air conditioning system, such that each motorized damper in an upper level return air duct moves to an open position when the thermostat switches a low voltage activation signal to the cooling system;

a motorized damper installed in each of the at least one lower level return air ducts, each motorized damper in a lower level return air duct having connection means for connecting the motorized damper in parallel with the low voltage activation signal to the heating system, such that each motorized damper in a lower level return air duct moves to an open position when the thermostat switches a low voltage activation signal to the heating system, a return spring connected to each of the motorized dampers in the upper level return air ducts and the lower level return air ducts, wherein each upper level motorized damper is operatively closed by a return spring such that when the thermostat switches a low voltage activation signal to the heating system the heating system effectively receives no return air flow through each lower level return air duct and substantially receives return air flow only from the lower level of the space where a greater portion of the cool air resides; and wherein the lower level motorized damper is operatively closed by a return spring such that when the thermostat alternatively switches a low voltage activation signal to the cooling system the cooling system substantially receives no return air flow through each lower level return air duct and effectively receives only return air flow from the upper level of the space where a greater portion of the warm air resides; and wherein when the thermostat is in cooling mode and each motorized damper in the lower return air ducts is in a closed position, the thermostat initiates circulating fan operation when the sensed upper level temperature is more than a predetermined amount above the sensed lower level temperature such that the circulating fan draws substantially all return air from the upper level of the space and evenly distributes the upper level air throughout all levels of the space to reduce the temperature stratification in the space.

3. A heating and cooling system for a multi-level space having at least one lower level return air duct and one upper level return air duct, the system comprising:

a thermostat having a sensor for sensing the temperature in the lower level, the thermostat being capable of controlling the operation of the heating or cooling system by switching a low voltage activation signal to either the heating system or the circulator fan of the cooling system;

a remote temperature sensor in the upper level for communicating upper level temperature information to the thermostat;

a motorized damper installed in each of the at least one upper level return air ducts, each motorized damper in an upper level return air duct having connection means for connecting the motorized damper in parallel with the low voltage activation signal to the air conditioning system, such that each motorized damper in an upper level return air duct moves to an open position when the thermostat switches a low voltage activation signal to the circulator fan of the cooling system;

a motorized damper installed in each of the at least one lower level return air ducts, the motorized damper in each lower level return air duct having a connection means for connecting the motorized damper in parallel with the low voltage activation signal to the heating system, such that the motorized damper in each lower level return air duct moves to an open position when the thermostat switches a low voltage activation signal to the heating system, a return spring connected to each of the motorized dampers in the upper level return air ducts and the lower level return air ducts, wherein each upper level motorized damper is operativel closed by a return spring such that when the thermostat switches a low voltage activation signal to the heating system the heating system effectively receives no return air flow through each lower level return air duct and substantially receives return air flow only from the lower level of the space where a greater portion of the cool air resides; and wherein the lower level motorized damper is operatively closed by a return spring when the thermostat alternatively switches a low voltage activation signal to the circulating fan such that the cooling system substantially receives no return air flow through each lower level return air duct and effectively receives only return air flow from the upper level of the space where a greater portion of the warm air resides;

wherein the thermostat sends a low voltage signal to the circulator fan when the average of the sensed upper and lower level temperatures is more than a predetermined amount above a set point temperature, such that the circulating fan draws substantially all return air from the upper level of the space and evenly distributes the upper level air throughout all levels of the space to reduce the temperature stratification in the space.

* * * * *